US010342350B2

(12) United States Patent
Britt

(10) Patent No.: US 10,342,350 B2
(45) Date of Patent: Jul. 9, 2019

(54) ANCHOR FOR ROCKING FURNITURE

(71) Applicant: ROCHOR LLC, Tybee Island, GA (US)

(72) Inventor: Peter Britt, Tybee Island, GA (US)

(73) Assignee: ROCHOR LLC, Tybee Island, GA (US)

( * ) Notice: Subject to any disclaimer, the term of this patent is extended or adjusted under 35 U.S.C. 154(b) by 171 days.

(21) Appl. No.: 15/600,314

(22) Filed: May 19, 2017

(65) Prior Publication Data

US 2018/0332971 A1 Nov. 22, 2018

(51) Int. Cl.
*A47C 3/029* (2006.01)
*A47C 3/03* (2006.01)

(52) U.S. Cl.
CPC ..... *A47C 3/03* (2013.01); *A47C 3/029* (2013.01)

(58) Field of Classification Search
CPC ..... A47C 3/02; A47C 1/0355; A47C 3/027; A47C 3/03
USPC ..... 297/270.5, 270.1, 270.3
See application file for complete search history.

(56) References Cited

U.S. PATENT DOCUMENTS 4,021,867 A * 5/1977 Maxwell, Jr. ..... A47D 9/02 297/270.2
5,248,120 A * 9/1993 Brien ..... A47C 3/02 248/370
5,427,342 A * 6/1995 Gagnon ..... A47B 91/00 182/108
6,290,294 B1 * 9/2001 Volz ..... A47C 3/03 297/270.1
6,511,127 B2 * 1/2003 Wilkens ..... A47C 3/029 248/188.8
7,438,272 B2 * 10/2008 Kee ..... A47C 7/006 16/30
7,527,560 B2 * 5/2009 Cadwallader ..... A47D 13/102 280/1.175
2004/0007908 A1 * 1/2004 Huang ..... A47C 3/027 297/261.1
2007/0096522 A1 * 5/2007 Bergeron ..... A47C 3/0255 297/270.1
2007/0296255 A1 * 12/2007 Cadwallader ..... A47D 13/102 297/270.5

* cited by examiner

*Primary Examiner* — Shin H Kim
(74) *Attorney, Agent, or Firm* — Johnson, Marcou & Isaacs, LLC

(57) ABSTRACT

An anchor for rocking furniture including left and right flat-bottomed elements longer than wider, with width less than half the spacing between rockers of rocking furniture to be anchored. A forward element releaseably impedes the flat-bottomed elements from separating by more than the rocker width at a first point forward of a back leg of the furniture plus a gap substantially less that the width of the wider flat-bottomed element at the first point. The forward element is vertically positioned between flat-bottomed elements above the height of the rocker at the first point. A rearward element impedes flat-bottom elements from separating by more than the rocker width at a second point rearward of the back leg plus a gap substantially less that the width of the wider flat-bottomed element at the second point. The rearward element is vertically positioned between the flat-bottomed elements below the rocker at the second point.

20 Claims, 7 Drawing Sheets

100

700

Provide a first rocking furniture anchor comprising:

a left flat-bottomed element and a right flat-bottomed element, each flat-bottomed element substantially longer front-to-back than wider left-to-right, and having a width less than one half the spacing between rocker elements of an item of rocking furniture to be anchored;

a forward element releaseably impeding the left flat-bottom element and the right flat-bottomed element from separating by more than: a width of the rocker element at a first point forward of a back leg of the furniture to be anchored, plus a gap substantially less that the width of the wider of the two flat-bottomed elements at the first point, the forward element vertically positioned between the left flat-bottomed element and the right flat bottomed element above the height of the rocker element at the first point; and a rearward element impeding the left flat-bottom element and the right flat-bottomed element from separating by more than: the width of the rocker element at a second point rearward of the back leg of the furniture to be anchored, plus a gap substantially less that the width of the wider of the two flat-bottomed elements at the second point, the rearward element vertically positioned between the left flat-bottomed element and the right flat bottomed element below the rocker element at the second point

710

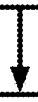

Place the first rocking furniture anchor, with the forward element released, around a first rocker element of the rocking furniture to be anchored, with the first point forward of a back leg of the furniture to be anchored at the first rocker element and the second point rearward of the back leg of the furniture to be anchored at the first rocker element

720

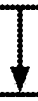

Releasably engage the forward element with each flat-bottomed element at the first point of the first rocker element

730

FIG. 7

ANCHOR FOR ROCKING FURNITURE

TECHNICAL FIELD

The technology disclosed herein is related to furniture accessories. Specific embodiments relate to anchors for rocking furniture.

SUMMARY

These and other aspects, objects, features, and advantages of the example embodiments will become apparent to those having ordinary skill in the art upon consideration of the following summary description of illustrated example embodiments.

Embodiments of the technology disclosed herein include devices, kits, and methods to anchor rocking furniture.

In some embodiments, the anchor includes a left flat-bottomed element and a right flat-bottomed element. Each flat-bottomed element substantially longer front-to-back than wider left-to-right. Each flat-bottomed element has a width less than one half the spacing between rocker elements of an item of rocking furniture to be anchored.

A forward element releaseably impedes the left flat-bottom element and the right flat-bottomed element from separating by more than: a width of the rocker element at a first point forward of a back leg of the furniture to be anchored, plus a gap substantially less that the width of the wider of the two flat-bottomed elements at the first point. The forward element is vertically positioned between the left flat-bottomed element and the right flat-bottomed element above the height of the rocker element at the first point.

A rearward element impedes the left flat-bottom element and the right flat-bottomed element from separating by more than: the width of the rocker element at a second point rearward of the back leg of the furniture to be anchored, plus a gap substantially less that the width of the wider of the two flat-bottomed elements at the second point. The rearward element is vertically positioned between the left flat-bottomed element and the right flat-bottomed element below the rocker element at the second point.

BRIEF DESCRIPTION OF THE DRAWINGS

FIG. 7 is a block flow diagram depicting methods of use of an anchor, in accordance with certain example embodiments.

DETAILED DESCRIPTION OF THE EXAMPLE EMBODIMENTS

Embodiments herein provide devices and methods for anchoring a piece of rocking furniture.

Figure 1:
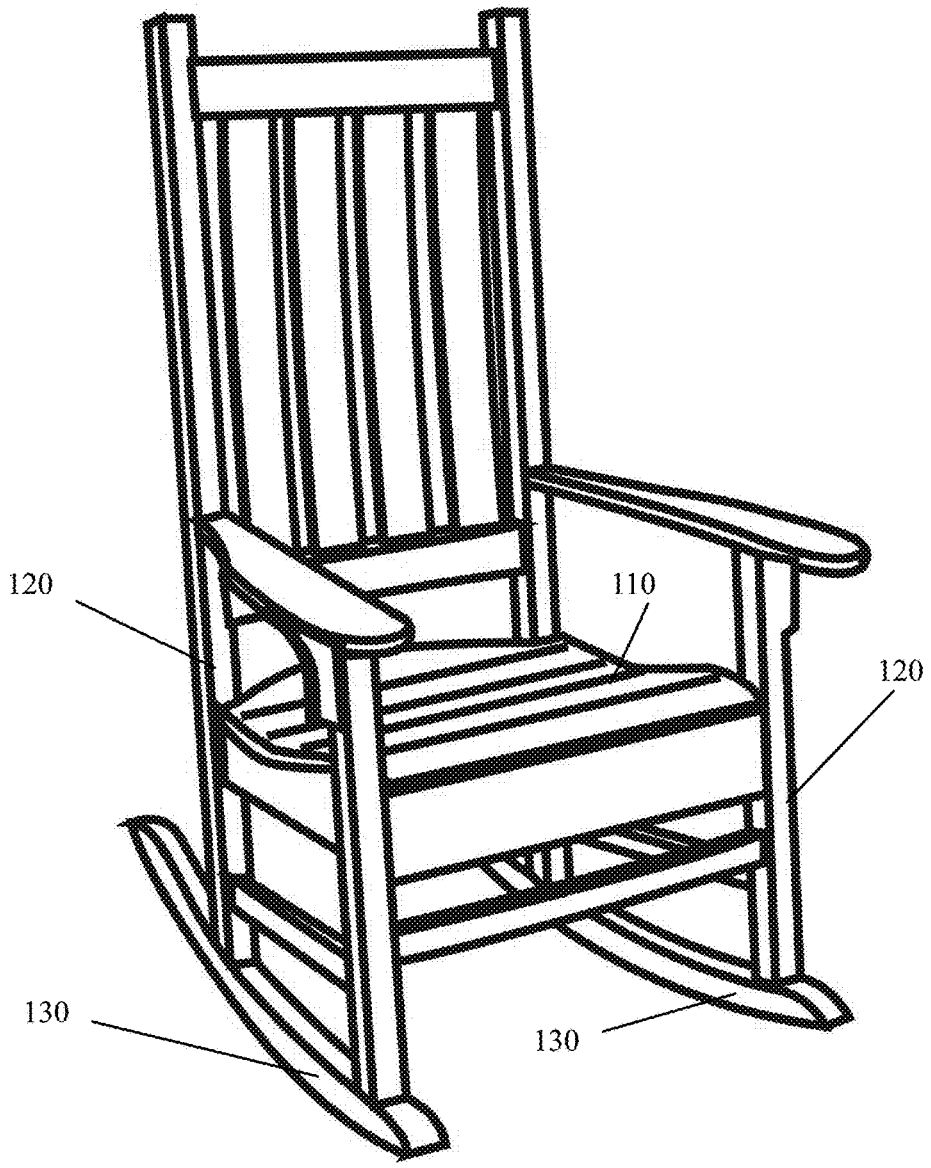
FIG. 1 is an illustration of a rocking chair.

Various types of rocking furniture, including rocking chairs and bassinets, are long well known. Referring to FIG. 1, each type of rocking furniture is characterized by a load-bearing surface, for example, the seat 110 in a rocking chair 100, attached via legs 120 to two curved elements, i.e., "rockers" 130, that contact a supporting surface such as a porch floor, a patio, or a deck. Rocking furniture can be found in use not only inside homes and businesses, but also outside on porches, in gazebos, and on lawns. In use, the point at which each rocker contacts the supporting surface changes until the center of gravity of the combination of the user/load and the rocking furniture align. For this reason, some considers rocking chairs ergonomic.

Rocking chairs have cultural significance associated with leisure, and are often placed on porches, decks, and lawns—both to facilitate relaxation and to present the image of relaxation. One setting in which the image of relaxation can be important is in the staging of vacation properties. Some vacation properties, particularly those at the seaside, are located where they are subject to strong winds. Strong winds may set un-anchored rocking furniture in motion across the supporting surface. For unanchored rocking furniture placed outside a vacation property in a windy location, the furniture may bang against the building, or may be blown off the supporting surface (such as a porch). Both damage to the structure and rocking furniture strewn about the property are not desirable images for a vacation property owner. Further, rocking furniture may present an accident risk to pets, children, intoxicated people, and those with limited mobility, who may have difficulty sitting on or getting up from the rocking furniture.

By using and relying on the methods and assemblies described herein, the technology disclosed herein can anchor a piece of rocking furniture to the supporting surface, thereby impeding the rocking motion and mitigating the risk of movement, damage to nearby structures, and injury to animals and people.

Turning now to the remainder of the drawings, in which like numerals represent like (but not necessarily identical) elements throughout the figures, example embodiments are described in detail.

Figure 2:
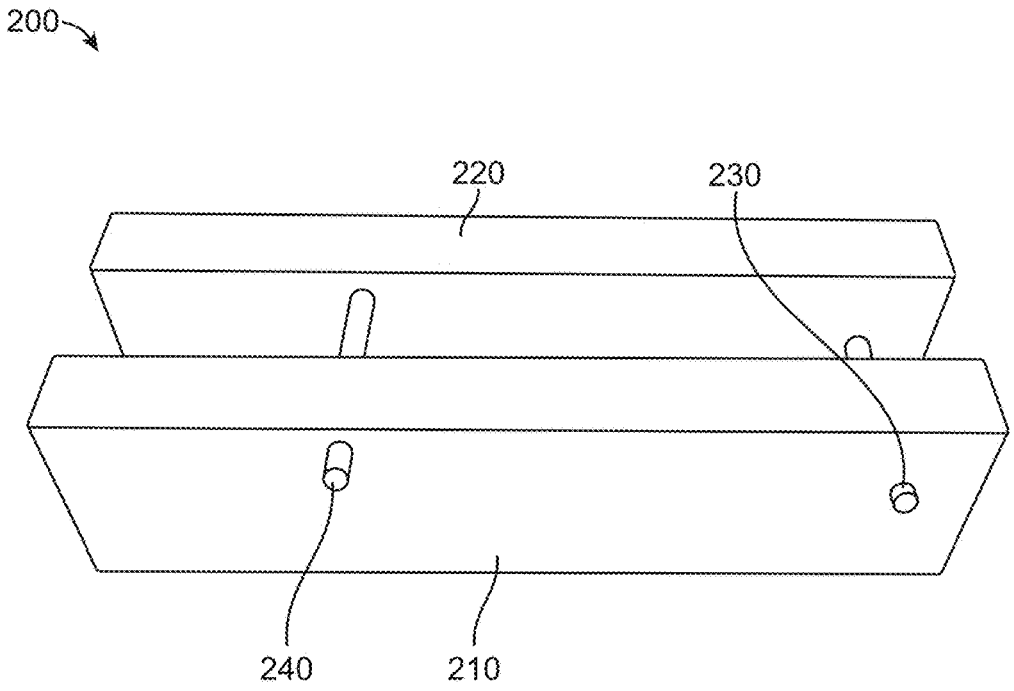
FIG. 2 is an illustration of an anchor for rocking furniture, in accordance with certain example embodiments.

Referring to FIG. 2, and continuing to refer to FIG. 1 for context, an illustration of an anchor for rocking furniture is shown, in accordance with certain example embodiments. In such an anchor 200, a left flat-bottomed first element 210 and a right flat bottomed second element 220 are joined by a forward third element 230 and a rearward fourth element 240 creating a space in between element 220 and 230 to accept a rocker 130 of the rocking furniture 100. While a rocking chair 100 is shown in FIG. 1, the anchor 200 offers utility for any type of rocking furniture comprising a rocking element such as rocking element 130. A rocking cradle or bassinet is one such type of rocking furniture.

While anchor 200 is shown with left flat-bottomed element 210 and a right flat bottomed element 220 as flat on each side, in some embodiments of the anchor 200, only the bottom of each element 210 and element 220 are flat. Other edges and surfaces of each element 210 and element 220 can be curved, for example, to reduce the risk of injury from a stubbed toe, or to provide a distinguishing design for aesthetic purposes and/or as an indication of the source or origin of the anchor.

Each of a left flat-bottomed element 210 and a right flat-bottomed element 220 are substantially longer front-to-back than wider left-to-right. This geometry facilitates the front-to-back stability desired of the anchor 200. Each element 210, 220 has a width less than one half the spacing between rocker elements 130 of an item of rocking furniture 100 to be anchored. In part, this allows interchangeability among anchors 200 used to secure rocking furniture 100 having two rockers 130. In some embodiments, the left flat-bottomed element 210 and a right flat-bottomed element 220 are interchangeable, which can improve manufacturability of the anchor 200.

In some embodiments, one of the left flat-bottomed element 210 and a right flat bottomed element 220 can be wider than the other and/or longer than the other. In some embodiments, each of a left flat-bottomed element 210 and a right flat-bottomed element 220 are made of wood. In some embodiments, each of a left flat-bottomed element 210 and a right flat-bottomed element 220 are made of a plastic such as high-density polyethylene (HDPE). In some embodiments, each of a left flat-bottomed element 210 and a right flat-bottomed element 220 are made of a metal, such as aluminum or iron. In some embodiments, each of a left flat-bottomed element 210 and a right flat-bottomed element 220 are coated with rubber or another friction enhancing material (such as friction tape, or a non-marking rubber), especially on the bottom of the element 210, 220.

Forward element 230 releasably impedes the left flat-bottom element 210 and the right flat-bottomed element 220 from separating by more than a width of the rocker element 130 at a first point forward of a back leg 120 of the furniture to be anchored 100, plus a gap substantially less that the width of the wider of the two flat-bottomed elements 210, 220 at the first point. The forward element 230 is releasable to allow the forward element to connect the two flat-bottomed elements 210, 220 through the closed space between the rocker 130, the seat 110, and the two legs 120 on a given side of the rocking furniture 100 to be anchored.

The forward element 230 is vertically positioned between the left flat-bottomed element 210 and the right flat-bottomed element 220 above the height of the rocker 130 at the first point. This causes the forward element 230 to impede the rocker 130 from raising any higher than the forward element 230 at the first point or from allowing the rocker 130, and hence the rocking furniture 100, from moving out of the anchor 200.

In some embodiments, the vertical position of the forward element 230 can be adjusted vertically to more snugly restrict the vertical motion of the rocker 130 at the first point, for example, by each of the left flat-bottom element 210 and the right flat-bottomed element 220 forming therein a vertical line of apertures (or an array of apertures, or a single vertical aperture for adjusting and slots for securing—as further described elsewhere herein). In some embodiments, the forward element 230 is cushioned, for example with foam, cloth, or a non-marking rubber, in the area subject to contact with the rocker 130. In some embodiments, the forward element 230 can be elastic material secured at posts on the top of each flat-bottomed element 210, 220.

Figure 3:
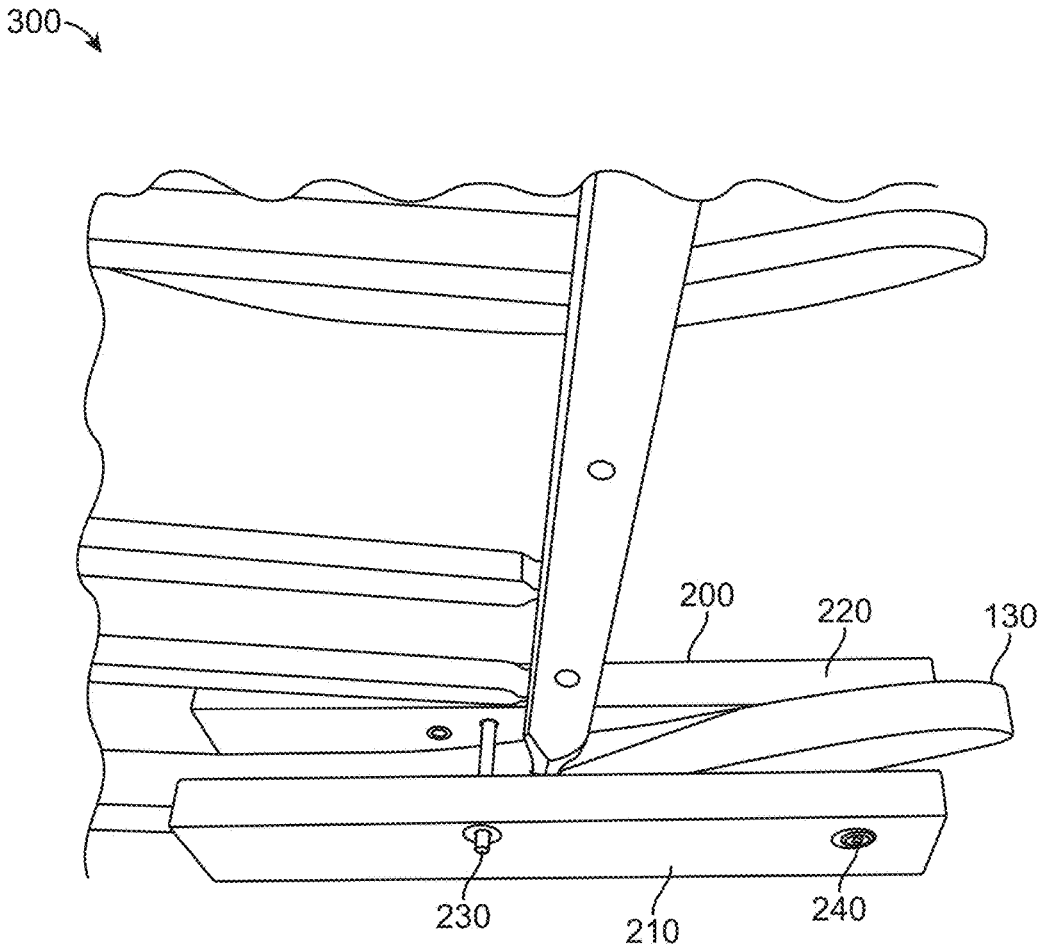
FIG. 3 is an illustration of the anchor of FIG. 2 in use with a piece of rocking furniture, in accordance with certain example embodiments.

In some embodiments, as in the embodiments illustrated in FIG. 2 and FIG. 3, each of the left flat-bottomed element 210 and a right flat-bottomed element 220 define therein a forward aperture (at the first point) in the face of the respective flat-bottomed element facing the other flat-bottomed element. In such embodiments, the forward element 230 engages each aperture at distal ends of the releasable forward element 230.

Rearward element 240 impedes the left flat-bottom element 210 and the right flat-bottomed element 220 from separating by more than a width of the rocker element 130 at a second point rearward of a back leg 120 of the furniture to be anchored 100, plus a gap substantially less that the width of the wider of the two flat-bottomed elements 210, 220 at the second point. In some embodiments, the rearward element 240 is releasable, for example to allow for more compact storage when not in use.

The rearward element 240 is vertically positioned between the left flat-bottomed element 210 and the right flat-bottomed element 220 below the bottom of the rocker 130 at the second point. This causes the rearward element 240 to prevent the rocker 130 from dropping any lower than the rearward element 240 at the second point. This, in combination with the tendency of the rocking furniture 100 toward a position aligning a line from its center of gravity perpendicular to the supporting surface, will impede the rocking chair 100 from rocking (anchor it).

In some embodiments, the vertical position of the forward element can be adjusted vertically to more snugly restrict the vertical motion of the rocker 130 at the first point, for example, by each of the left flat-bottom element 210 and the right flat-bottomed element 220 forming therein a vertical line of apertures (or a single vertical aperture for adjusting and slots for securing) at the second point. In some embodiments, the rearward element is cushioned, for example with foam, cloth, or a non-marking rubber.

Figure 4:
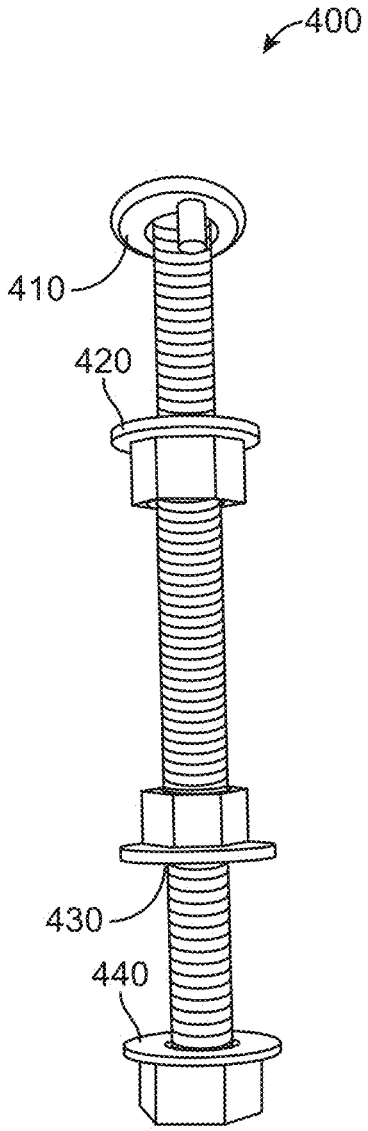
FIG. 4 is an illustration of a rearward element of the anchor, in accordance with certain example embodiments.

In some embodiments, as in the embodiments illustrated in FIG. 2 and FIG. 3, each of the left flat-bottomed element 210 and a right flat-bottomed element 220 define therein a rearward aperture (at the second point) in the face of the respective flat-bottomed element facing the other flat-bottomed element. In such embodiments, the rearward element 240 engages each aperture at distal ends of the rearward element 240. For example, referring to FIG. 4, and continuing to refer to prior figures for context, a the rearward element 400 can include bolt 410 that is slid/threaded through the outer face of the rearward aperture of the left flat-bottomed element 210. The left nut assembly 420 (in this embodiment a nut with a captive washer, but in other embodiments a separate nut and separate washer) is threaded on to the bolt 410 with the washer facing the interior face of the left flat-bottomed element 210, and snugged against the interior face of the left flat-bottomed element 210.

The right nut assembly 430 is then threaded onto the bolt 410 as shown (with the washer facing the inside face of the right flat-bottomed element 220) so that the distance between the exposed washer faces corresponds to the width of the rocker element 130 at the second point, plus a gap substantially less that the width of the wider of the two flat-bottomed elements 210, 220 at the second point.

The end of bolt 410 then is slid/threaded through the rearward aperture in the inward face of right flat-bottomed element 220, and end nut assembly 440 is threaded on to the bolt where it is exposed through the outward face of the right flat-bottomed element 220 to secure the right flat-bottomed element 220 in place.

Various other arrangements can be used in place of rearward element 400, including a hook- and loop strap (in conjunction with a rigid forward element) either threaded through apertures in the left flat-bottomed element 210 and the right flat-bottomed element 220 and wrapped around the top or bottom (guided in a bottom groove) of the elements 210, 220. A hitch pin with pre-drilled holes for cotter pins corresponding to the location of the bolt 410 head and each nut assembly can be used to substantially the same effect, as can a gate hook and eye assembly applied to the inside face of the elements 210, 220.

Figure 5:
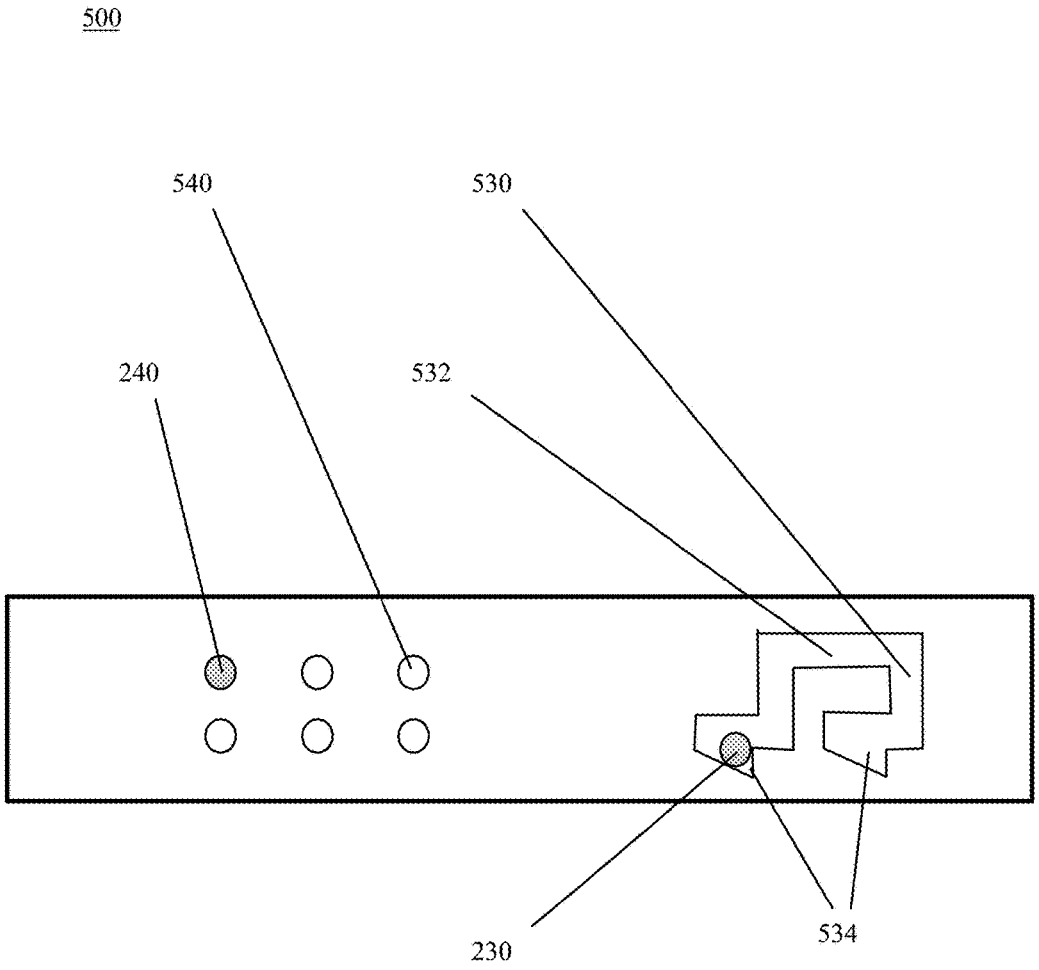
FIG. 5 is a side view of an anchor with apertures for adjusting the positions of the forward element and the rearward element, in accordance with certain example embodiments.

Referring to FIG. 5, and continuing to refer to prior figures for context, an embodiment of the anchor 500 (shown in left side view), in accordance with certain example embodiments is shown. In such embodiments, the forward aperture 530 comprises front-to-back channel 532 in an upper portion of the forward aperture 530 and a plurality of slots 534 in a lower portion of the aperture. The channel is sized to allow free movement of the portion of the forward element 240 engaging the forward aperture 530 from front to back in the channel 532. Each slot 534 is sized to receive the portion of the forward element 230 engaging the forward aperture 530. Each slot is biased to impede forward motion of the forward element 230 engaged in the slot 534. Such an approach also can be applied to positioning of the rearward element 240.

In FIG. 5, an array of rear apertures, for example 540, allowing for both horizontal and vertical adjustment of the position of the rearward element 240 also is shown. Such an approach also can be applied to positioning of the forward element 230.

In some embodiments, the left flat-bottomed element 210, the right flat-bottomed element 220, and the rearward element 240 form a continuous piece.

Figure 6:
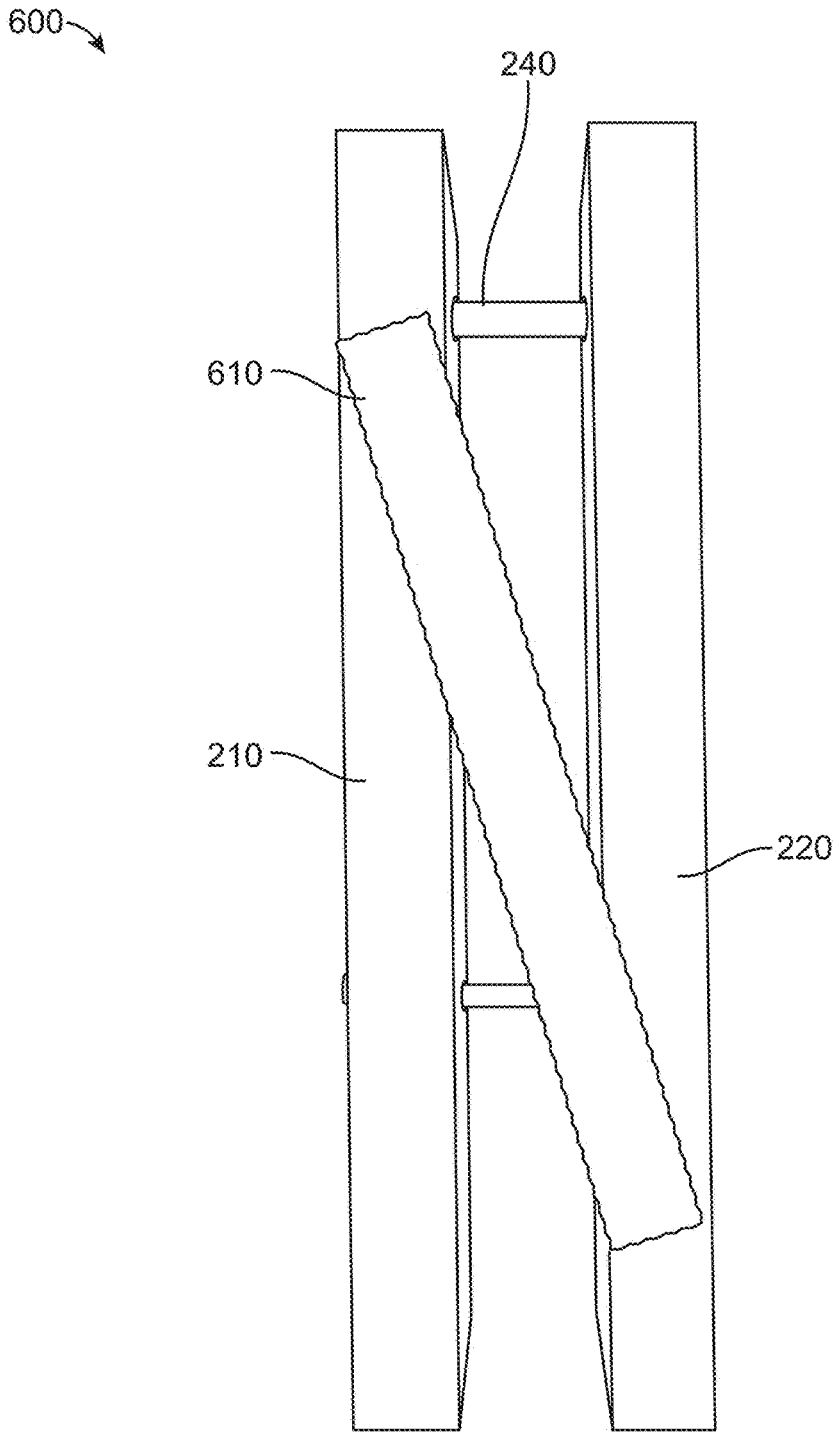
FIG. 6 is bottom view of an anchor with a bottom tie, in accordance with certain example embodiments.

Referring to FIG. 6, and continuing to refer to prior figures for context, an embodiment of the anchor 600, in accordance with certain example embodiments is shown from a bottom view. In such embodiments of the anchor 600 include a bottom tie 610 joining the left flat-bottomed element 210 and a right flat-bottomed element 220 at the bottom of each flat-bottomed element, wherein the bottom tie 610 is recessed into the bottom of each flat-bottomed element. In the depicted embodiment, bottom tie 610 is a substantially rigid strap attached to the rear bottom surface of the left flat-bottomed element 210 and to the front bottom surface of the right flat-bottomed element 220.

Each of the individual components of the anchor described herein can be assembled as a kit for assembly, for example, for assembly by an end user.

Referring to FIG. 7, a block flow diagram depicting a method 700 to anchor a piece of rocking furniture is shown, in accordance with certain example embodiments of the technology disclosed herein. In such embodiments, a first rocking furniture anchor is provided—Block 710. The first rocking furniture includes a left flat-bottomed element and a right flat-bottomed element. Each flat-bottomed element is substantially longer front-to-back than wider left-to-right. Each flat-bottomed element has a width less than one half the spacing between rocker elements of an item of rocking furniture to be anchored.

The anchor includes a forward element releaseably impeding the left flat-bottom element and the right flat-bottomed element from separating by more than: a width of the rocker element at a first point forward of a back leg of the furniture to be anchored, plus a gap substantially less that the width of the wider of the two flat-bottomed elements at the first point. The forward element is vertically positioned between the left flat-bottomed element and the right flat-bottomed element above the height of the rocker element at the first point.

The anchor includes a rearward element impeding the left flat-bottom element and the right flat-bottomed element from separating by more than: the width of the rocker element at a second point rearward of the back leg of the furniture to be anchored, plus a gap substantially less that the width of the wider of the two flat-bottomed elements at the second point. The rearward element is vertically positioned between the left flat-bottomed element and the right flat-bottomed element below the rocker element at the second point.

The first rocking furniture anchor is placed, with the forward element released, around a first rocker element of the rocking furniture to be anchored—with the first point forward of a back leg of the furniture to be anchored at the first rocker element and the second point rearward of the back leg of the furniture to be anchored at the first rocker element—Block 720.

The forward element is releasably engaged with each flat-bottomed element at the first point of the first rocker element—Block 730.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the scope of the following claims, which are to be accorded the broadest interpretation to encompass such alternate embodiments.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of embodiments defined in the following claims, the scope of which is to be accorded the broadest interpretation so as to encompass such modifications and equivalent structures.

The invention claimed is:

1. A rocking furniture anchor comprising:

a left flat-bottomed first element and a right flat-bottomed second element, each flat-bottomed element substantially longer front-to-back than wider left-to-right, and having a width less than one half the spacing between rocker elements of an item of rocking furniture to be anchored;

a forward third element releaseably impeding the left flat-bottom element and the right flat-bottomed element from separating by more than: a width of the rocker element at a first point forward of a back leg of the furniture to be anchored, plus a gap substantially less that the width of the wider of the two flat-bottomed elements at the first point, the forward element vertically positioned between the left flat-bottomed element and the right flat bottomed element above the height of the rocker element at the first point; and a rearward fourth element impeding the left flat-bottom element and the right flat-bottomed element from separating by more than: the width of the rocker element at a second point rearward of the back leg of the furniture to be anchored, plus a gap substantially less that the width of the wider of the two flat-bottomed elements at the second point, the rearward element vertically positioned between the left flat-bottomed element and the right flat bottomed element below the rocker element at the second point.

2. The rocking furniture anchor of claim 1 wherein:

each of the left flat-bottomed element and a right flat-bottomed element define therein a rearward aperture in the face of the respective flat-bottomed element facing the other flat-bottomed element; and the rearward element engages each aperture at distal ends of the rearward element.

3. The rocking furniture anchor of claim 1 wherein:

each of the left flat-bottomed element and a right flat-bottomed element define therein a forward aperture in the face of the respective flat-bottomed element facing the other flat-bottomed element; and the forward element engages each aperture at distal ends of the forward element.

4. The rocking furniture anchor of claim 3 wherein:

the forward aperture is a through hole, and the forward element comprises a rod threaded at both ends and a nut securing each forward element rod end to the respective flat-bottomed element.

5. The rocking furniture anchor of claim 3 wherein:

the forward aperture comprises front-to-back channel in an upper portion of the forward aperture and a plurality of slots in a lower portion of the aperture;

the channel is sized to allow free movement of the portion of the forward element engaging the forward aperture from front to back in the channel;

each slot is sized to receive the portion of the forward element engaging the forward aperture; and each slot is biased to impede forward motion of the forward element engaged in the slot.

6. The rocking furniture anchor of claim 1 further comprising:

a bottom tie joining the left flat-bottomed element and a right flat-bottomed element at the bottom of each flat-bottomed element, wherein the bottom tie is recessed into the bottom of each flat-bottomed element.

7. The rocking furniture anchor of claim 6 wherein:

the bottom tie is joined to the rear of one of the left flat-bottomed element and a right flat-bottomed element and the front of the other left flat-bottomed element and a right flat-bottomed element.

8. The rocking furniture anchor of claim 1 wherein:

the left flat-bottomed element, right flat-bottomed element, and rearward element form a continuous piece.

9. The rocking furniture anchor of claim 1 wherein:

the left flat-bottomed element and right flat-bottomed element are formed from one of high-density polyethylene (HDPE) and wood.

10. The rocking furniture anchor of claim 1 wherein the forward element comprises a gate hook and eye.

11. A rocking furniture anchor kit, comprising:

a left flat-bottomed element and a right flat-bottomed element, each flat-bottomed element: substantially longer front-to-back than wider left-to-right, and having a width less than one half the spacing between rocker elements of an item of rocking furniture to be anchored;

a forward element adapted to releaseably impede the left flat-bottom element and the right flat-bottomed element from separating by more than: a width of the rocker element at a first point forward of a back leg of the furniture to be anchored, plus a gap substantially less that the width of the wider of the two flat-bottomed elements at the first point, the forward element adapted to be vertically positioned between the left flat-bottomed element and the right flat bottomed element above the height of the rocker element at the first point; and a rearward element adapted to impeding the left flat-bottom element and the right flat-bottomed element from separating by more than the width of the rocker element at a second point rearward of the back leg of the furniture to be anchored, plus a gap substantially less that the width of the wider of the two flat-bottomed elements at the second point, the rearward element vertically positioned between the left flat-bottomed element and the right flat bottomed element below the rocker element at the second point.

12. The rocking furniture anchor kit of claim 11 wherein:

each of the left flat-bottomed element and a right flat-bottomed element define therein a rearward aperture in the face of the respective flat-bottomed element facing the other flat-bottomed element; and the rearward element engages each aperture at distal ends of the rearward element.

13. The rocking furniture anchor kit of claim 11 wherein:

each of the left flat-bottomed element and a right flat-bottomed element define therein a forward aperture in the face of the respective flat-bottomed element facing the other flat-bottomed element; and the forward element engages each aperture at distal ends of the forward element.

14. The rocking furniture anchor kit of claim 13 wherein:

the forward aperture is a through hole, and the forward element comprises a rod threaded at both ends and a nut securing each forward element rod end to the respective flat-bottomed element.

15. The rocking furniture anchor kit of claim 13 wherein:

the forward aperture comprises front-to-back channel in an upper portion of the forward aperture and a plurality of slots in a lower portion of the aperture;

the channel is sized to allow free movement of the portion of the forward element engaging the forward aperture from front to back in the channel;

each slot is sized to receive the portion of the forward element engaging the forward aperture; and each slot is biased to impede forward motion of the forward element engaged in the slot.

16. The rocking furniture anchor kit of claim 11 further comprising:

a bottom tie joining the left flat-bottomed element and a right flat-bottomed element at the bottom of each flat-bottomed element, wherein the bottom tie is recessed into the bottom of each flat-bottomed element.

17. The rocking furniture anchor kit of claim 11 wherein:

the bottom tie is joined to the rear of one of the left flat-bottomed element and a right flat-bottomed element and the front of the other left flat-bottomed element and a right flat-bottomed element.

18. The rocking furniture anchor kit of claim 11 wherein:

the left flat-bottomed element, right flat-bottomed element, and rearward element form a continuous piece.

19. A method for anchoring rocking furniture, comprising:

providing a first rocking furniture anchor comprising:

a left flat-bottomed element and a right flat-bottomed element, each flat-bottomed element substantially longer front-to-back than wider left-to-right, and having a width less than one half the spacing between rocker elements of an item of rocking furniture to be anchored;

a forward element releaseably impeding the left flat-bottom element and the right flat-bottomed element from separating by more than: a width of the rocker element at a first point forward of a back leg of the furniture to be anchored, plus a gap substantially less that the width of the wider of the two flat-bottomed elements at the first point, the forward element vertically positioned between the left flat-bottomed element and the right flat bottomed element above the height of the rocker element at the first point; and a rearward element impeding the left flat-bottom element and the right flat-bottomed element from separating by more than: the width of the rocker element at a second point rearward of the back leg of the furniture to be anchored, plus a gap substantially less that the width of the wider of the two flat-bottomed elements at the second point, the rearward element vertically positioned between the left flat-bottomed element and the right flat bottomed element below the rocker element at the second point;

placing the first rocking furniture anchor, with the forward element released, around a first rocker element of the rocking furniture to be anchored, with the first point forward of a back leg of the furniture to be anchored at the first rocker element and the second point rearward of the back leg of the furniture to be anchored at the first rocker element;

releasably engaging the forward element with each flat-bottomed element at the first point of the first rocker element.

20. The method of claim 19, further comprising:

providing a second rocking furniture anchor comprising:

a left flat-bottomed element and a right flat-bottomed element, each flat-bottomed element substantially longer front-to-back than wider left-to-right, and having a width less than one half the spacing between rocker elements of an item of rocking furniture to be anchored;

a forward element releaseably impeding the left flat-bottom element and the right flat-bottomed element from separating by more than: a width of the rocker element at a first point forward of a back leg of the furniture to be anchored, plus a gap substantially less that the width of the wider of the two flat-bottomed elements at the first point, the forward element vertically positioned between the left flat-bottomed element and the right flat bottomed element above the height of the rocker element at the first point; and a rearward element impeding the left flat-bottom element and the right flat-bottomed element from separating by more than: the width of the rocker element at a second point rearward of the back leg of the furniture to be anchored, plus a gap substantially less that the width of the wider of the two flat-bottomed elements at the second point, the rearward element vertically positioned between the left flat-bottomed element and the right flat bottomed element below the rocker element at the second point;

placing the rocking furniture anchor, with the forward element released, around a second rocker element of the rocking furniture to be anchored, with the first point forward of a back leg of the furniture to be anchored and the second point rearward of the back leg of the furniture to be anchored;

releasably engaging the forward element with each flat-bottomed element at the first point.

* * * * *